US012435479B2

(12) United States Patent
Rosenbaugh et al.

(10) Patent No.: US 12,435,479 B2
(45) Date of Patent: Oct. 7, 2025

(54) BARRIER SYSTEM

(71) Applicant: NUtech Ventures, Lincoln, NE (US)

(72) Inventors: Scott Kenneth Rosenbaugh, Lincoln, NE (US); Jennifer Dawn Rasmussen, Eagle, NE (US); Ronald Keith Faller, Lincoln, NE (US); Robert W. Bielenberg, Lincoln, NE (US); James C. Holloway, Lincoln, NE (US); Karla Ann Lechtenberg, Raymond, NE (US); John D. Reid, Lincoln, NE (US)

(73) Assignee: NUtech Ventures, Lincoln, NE (US)

( * ) Notice: Subject to any disclaimer, the term of this patent is extended or adjusted under 35 U.S.C. 154(b) by 519 days.

(21) Appl. No.: 16/640,460

(22) PCT Filed: Aug. 24, 2018

(86) PCT No.: PCT/US2018/047866
§ 371 (c)(1),
(2) Date: Feb. 20, 2020

(87) PCT Pub. No.: WO2019/040821
PCT Pub. Date: Feb. 28, 2019

(65) Prior Publication Data

US 2020/0217028 A1 Jul. 9, 2020

Related U.S. Application Data

(60) Provisional application No. 62/550,304, filed on Aug. 25, 2017.

(51) Int. Cl.
*E01F 15/04* (2006.01)

(52) U.S. Cl.
CPC ..... *E01F 15/0446* (2013.01); *E01F 15/0461* (2013.01); *E01F 15/0453* (2013.01)

(58) Field of Classification Search
CPC ... E01F 15/02; E01F 15/0446; E01F 15/0453; E01F 15/0461; E01F 15/083; E01F 15/088; F16B 7/18; F16B 2200/506
(Continued)

(56) References Cited

U.S. PATENT DOCUMENTS 3,674,115 A * 7/1972 Young ..... E01F 15/146 267/116
3,963,218 A * 6/1976 Glaesener ..... E01F 15/0453 404/6

(Continued)

FOREIGN PATENT DOCUMENTS

DE 3816528 A1 * 3/1989 ..... E01F 15/143
DE 3914208 A1 * 10/1990 ..... E01F 15/00

(Continued)

OTHER PUBLICATIONS

European Patent Office, International Search Report in International Patent Application No. PCT/US2018/047866, 4 pp. (Oct. 31, 2018).

(Continued)

*Primary Examiner* — Amber R Anderson
*Assistant Examiner* — Zachary A Hall
(74) *Attorney, Agent, or Firm* — Leydig, Voit & Mayer, Ltd.

(57) ABSTRACT

A barrier system includes first and second barrier segments connected to one another. The connection between the segments includes a pair of wedge-shaped connectors disposed between angled faces formed at the opposing ends of the segments. Elastic pads are sandwiched between the respective segment faces and connectors.

20 Claims, 15 Drawing Sheets

(58) Field of Classification Search
USPC ..... 256/13.1; 52/848, 849
See application file for complete search history.

(56) References Cited

U.S. PATENT DOCUMENTS

| | | | | |
|---|---|---|---|---|
| 5,011,325 | A * | 4/1991 | Antonioli | E01F 15/086 404/6 |
| 5,276,949 | A * | 1/1994 | Cordellini | F16B 2/12 24/569 |
| 5,286,136 | A * | 2/1994 | Mandish | E01F 15/0476 404/6 |
| 8,079,774 | B2 * | 12/2011 | House | E01F 15/083 404/6 |
| 9,976,266 | B1 * | 5/2018 | Rosenbaugh | E01F 15/0461 |
| 2004/0146345 | A1 | 7/2004 | Consolazio et al. | |
| 2012/0269574 | A1 * | 10/2012 | Redlberger | E01F 15/083 404/6 |

FOREIGN PATENT DOCUMENTS

| | | | | |
|---|---|---|---|---|
| DE | 4337074 | A1 * | 5/1995 | E01F 15/143 |
| DE | 102008052124 | A1 | 4/2010 | |
| EP | 0310754 | A2 * | 4/1989 | E02D 29/0266 |
| EP | 1124014 | A2 * | 8/2001 | E01F 15/083 |
| EP | 2468958 | A1 | 6/2012 | |
| FR | 2714406 | A1 | 6/1995 | |
| GB | 2564704 | A * | 1/2019 | E01F 15/08 |
| KR | 101213075 | B1 * | 12/2012 | E01C 11/223 |
| WO | WO 2007/059542 | A1 | 5/2007 | |
| WO | WO-2008040343 | A1 * | 4/2008 | E01F 15/025 |

OTHER PUBLICATIONS

European Patent Office, Written Opinion in International Patent Application No. PCT/US2018/047866, 4 pp. (Oct. 31, 2018).

* cited by examiner

BARRIER SYSTEM

CROSS-REFERENCE TO RELATED APPLICATIONS

This patent application is the U.S. national phase of International Patent Application No. PCT/US2018/047866, filed on Aug. 24, 2018, and claims the benefit of U.S. Provisional Patent Application No. 62/550,304, filed Aug. 25, 2017, the disclosures of which are incorporated herein by reference in their entireties for all purposes.

FEDERALLY SPONSORED RESEARCH OR DEVELOPMENT

This invention was made with U.S. Government support under Grant No. DPUSTWD(94) awarded by the Federal Highway Administration/Nebraska Department of Roads (FHWA/NDOR). The U.S. Government has certain rights in this invention.

BACKGROUND

Barrier systems (including a plurality of barrier segments made from concrete, metal, and/or plastic) are often installed along roads to separate traffic moving in a first direction from traffic moving in a second (e.g., opposite) direction. Barriers can also be used to block off roads, building entrances, work zones, ditches, cliffs, and so forth. Typically, the barrier segments are rectangular, triangular, trapezoidal, or similar prism-like concrete, steel, or plastic structures that can be lined up with one another to form a barrier system having a selected length. While such barriers generally work to prevent drivers from entering blocked off territories, they can fail in high speed and/or high impact situations.

BRIEF SUMMARY OF THE DISCLOSURE

In one aspect, the present disclosure is directed to a barrier system. The barrier system includes a first barrier segment having a first angled face and has a generally elongate shape that extends along a longitudinal axis. The first angled face includes a first flat face extending perpendicularly to the longitudinal axis, and two first angled side faces disposed on either side of the first flat face. A second barrier segment has a second angled face and an elongate shape that extends along the longitudinal axis. The second angled face includes a second flat face extending parallel to the longitudinal axis and abutting the first flat face, and two second angled side faces disposed in opposed relation to the two first angled side faces. A a pair of wedge-shaped connectors is disposed, one each, in contact with opposing pairs of first and second angled side faces. A pair of elastic pads is disposed, one each, in contact between each of the pair of wedge-shaped connectors and a corresponding opposing pair of first and second angled side faces. At least one fastener is disposed between each of the pair of wedge-shaped connector and each of the first and second angled side faces.

In one embodiment, the two first angled side faces extend at an angle on either side of the longitudinal axis. In other embodiments, the at least one fastener extends through an opening formed in the first or second barrier segment, the opening being slot-shaped. The pair of elastic pads may be made from rubber, neoprene or a similar material that is suitable to absorb mechanical strain. The pair of elastic pads may also at least partially cover an entire contact area between the pair of wedge-shaped connectors and the first and second angled faces. In one disclosed embodiment, a first metal cap is disposed to at least partially cover an end of the first barrier segment, the first metal cap defining the first angled face. The first metal cap may be integrated with and embedded into the end of the first barrier segment. The first metal cap may also be plate-shaped in a tri-fold configuration. The first and/or the second barrier segment can be made from full-weight concrete material or from a lightweight concrete material.

Figure 7A:
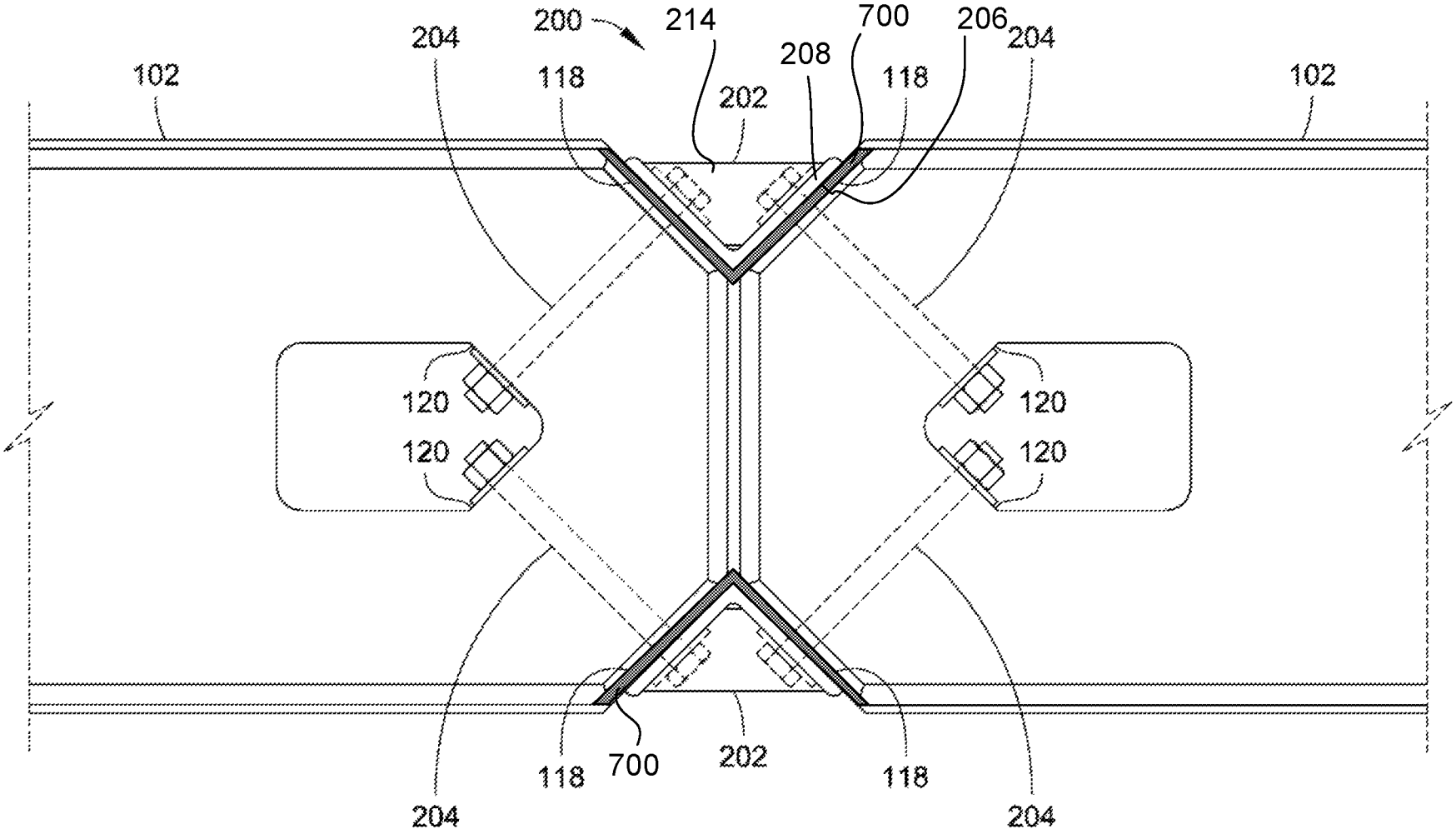
Figure 7B:
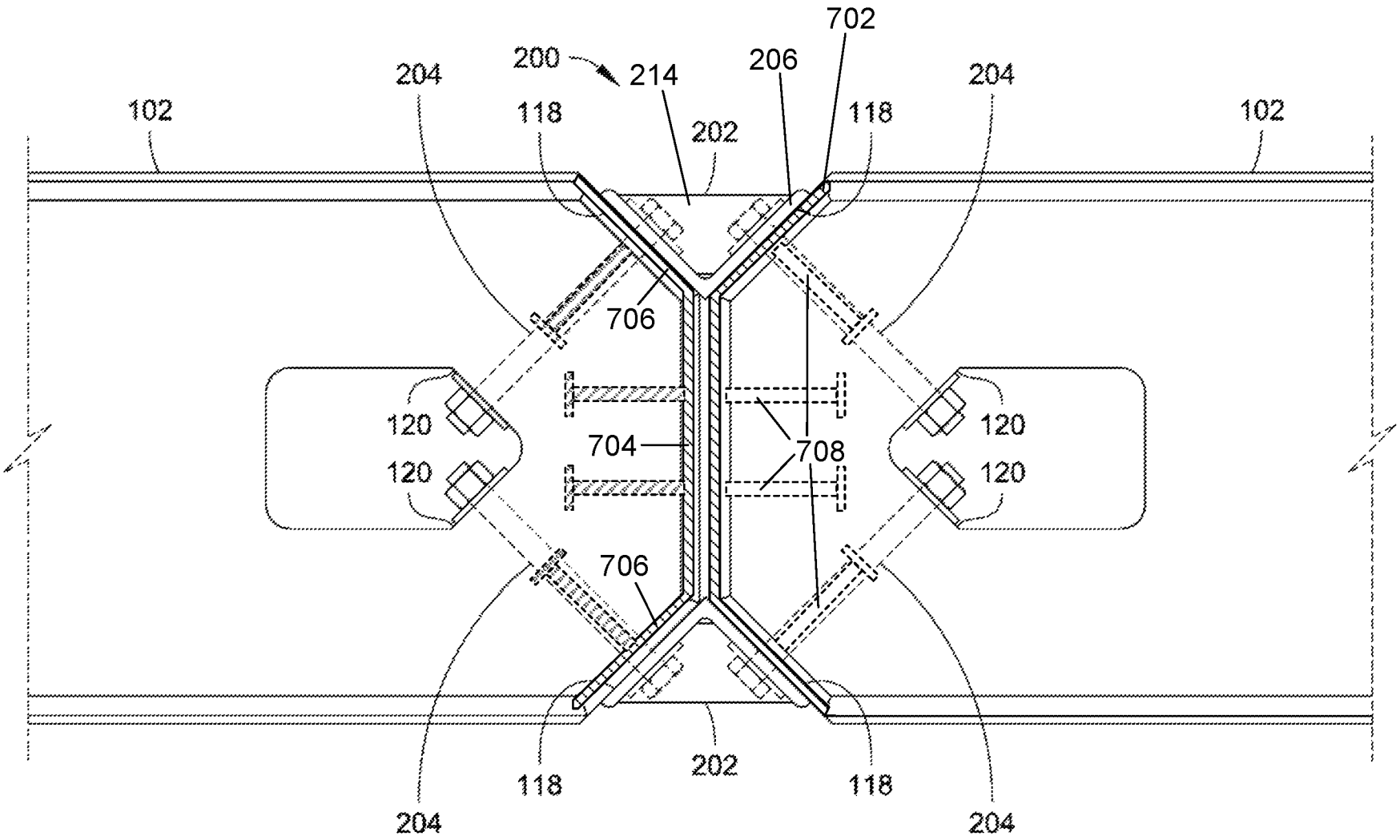
Figure 7C:
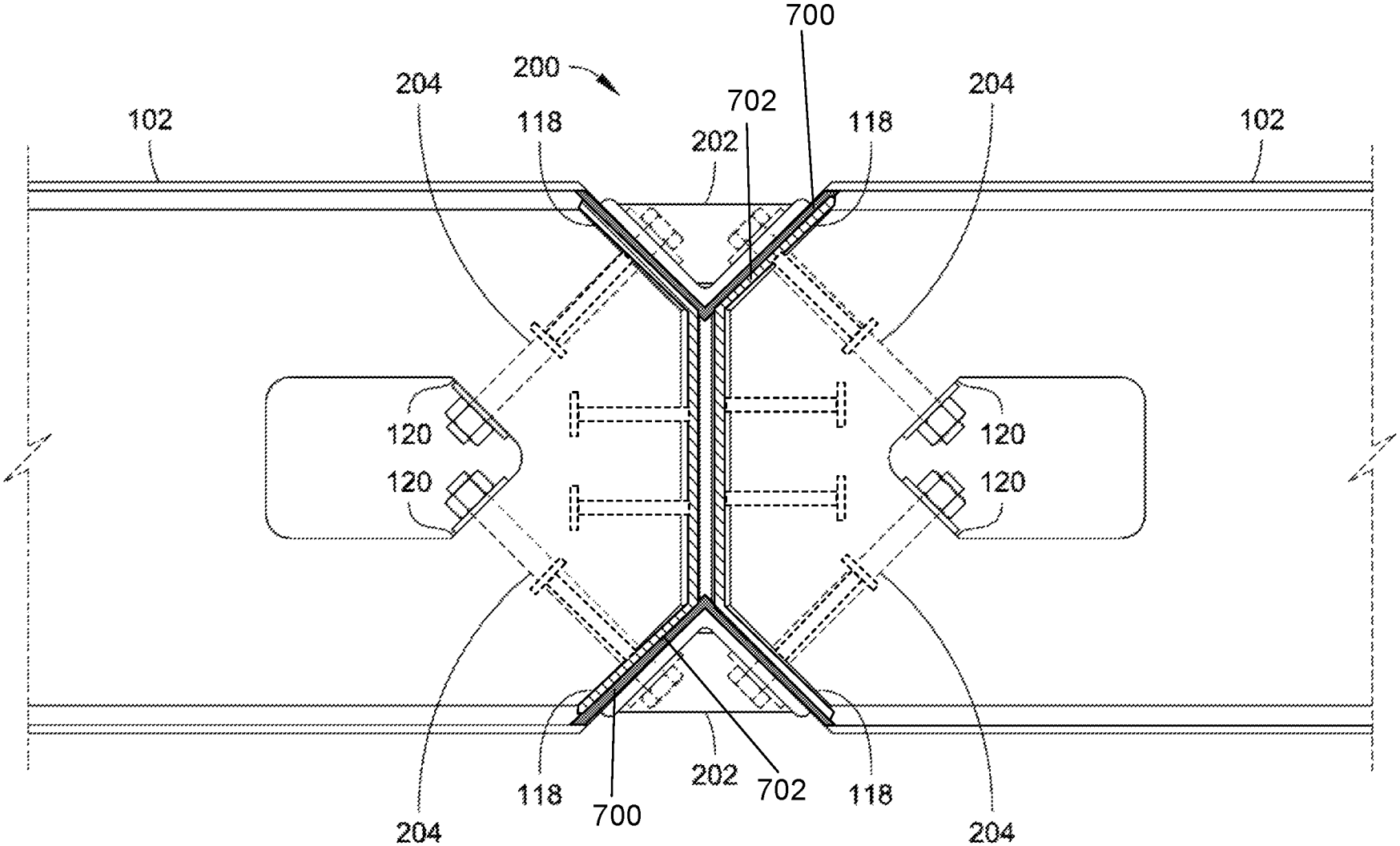

Each of FIGS. 7A, 7B and 7C is a top plan view of respective alternative embodiments of a coupling assembly in accordance with the disclosure.

Figure 8:
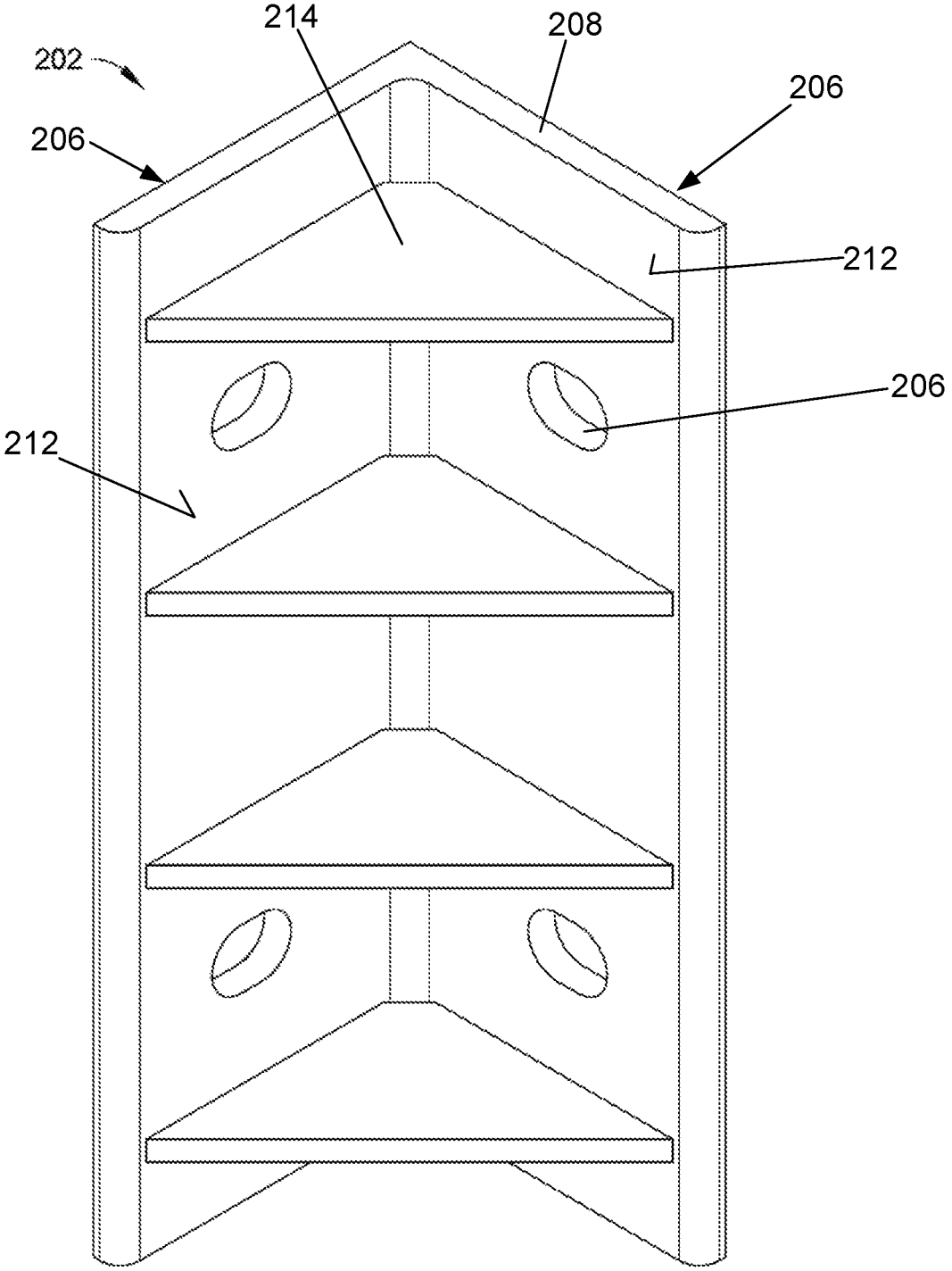

FIG. 8 is an isometric view of an angle joint for the coupling assembly illustrated in FIGS. 7A-7C.

FIGS. 9-12 are graphs of displacement v. time for various experiments conducted.

Figure 13:
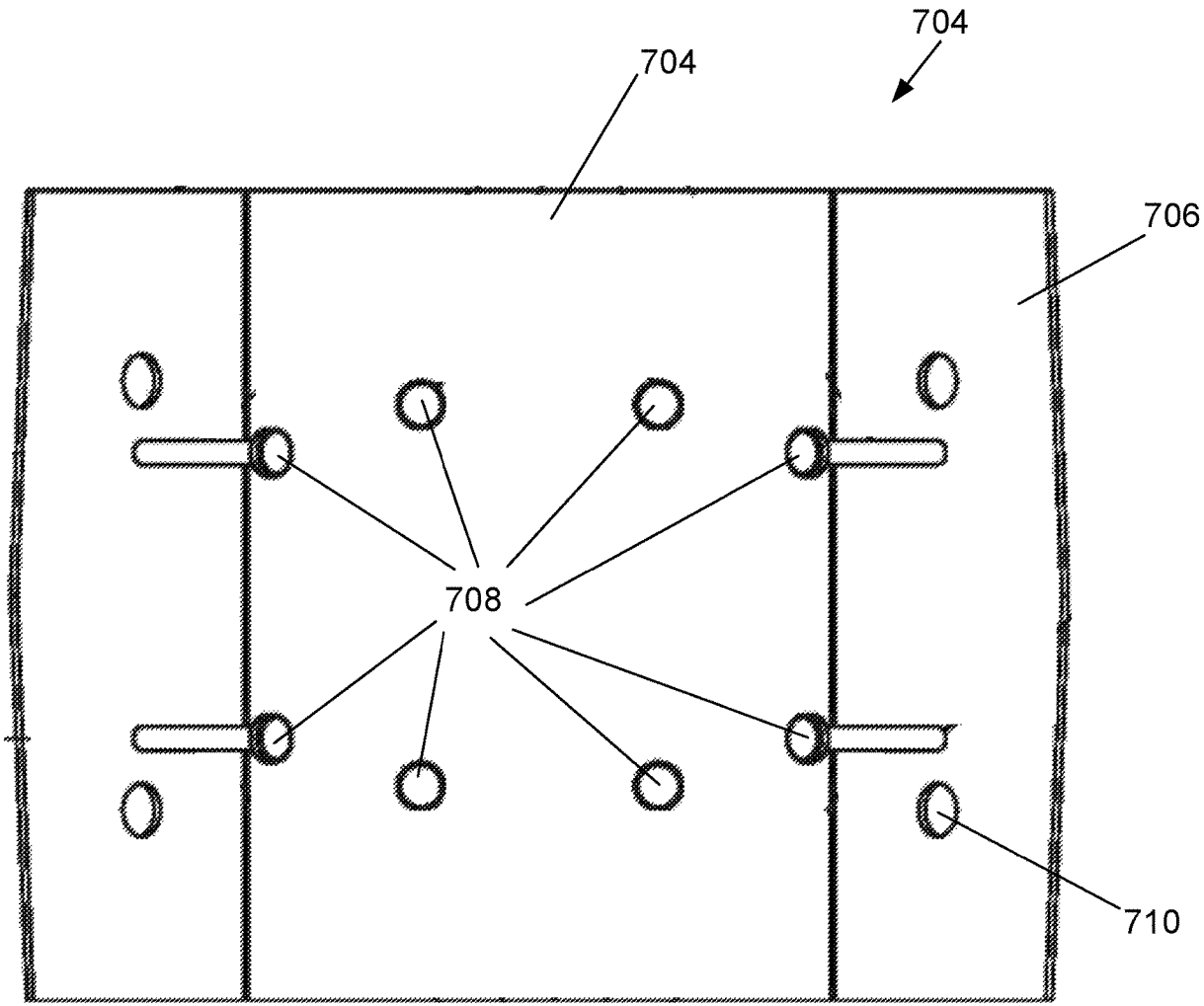

FIG. 13 is a front view of a metal cap in accordance with the disclosure.

DETAILED DESCRIPTION

The present disclosure relates to improvements to adjustable continuity joints (ACJ) such as those used to construct traffic barriers. In this respect, previously proposed designs of ACJ's for concrete barriers have been known to exhibit concrete cracking and spalling on the barrier beams, which may require repair or replacement following a crash. The present disclosure describes three different alternative embodiments for the ACJ, each of which was observed to advantageously provide improved resistance against cracking and spalling during a crash, while maintaining backward compatibility to the structures already installed in the field and without adding considerable cost or complexity to the barriers and connecting structures suggested. In general, the three alternative embodiments include 1) incorporating rubber bearing pads within the ACJ, 2) utilizing normal weight concrete instead of lightweight concrete, and 3) incorporating a steel end cap into the ends of the beam segments. It is contemplated that each of these three improvements can be used alone or in combination with one or both of the other damage improvements in a traffic barrier.

To evaluate the performance of the various alternative embodiments described herein, four dynamic component tests were conducted to evaluate the performance of these three joint variations against the performance of the original, as-tested, RESTORE ACJ. All three modified designs showed improved durability over the original ACJ. The normal weight concrete beams delayed the onset of cracking and fracture, but ultimately had similar damage to that of the baseline test. The rubber or neoprene pads reduced cracking and prevented fractures, but increased the flexibility of the joint. The pads also reduced concrete damage and prevented localized cracking by evenly distributing the impact force. The pads also delayed onset of cracking from 10 thousandths of a second to about 42 thousandths of a second. Finally, the steel end caps allowed only small hairline cracks to form while also stiffening the joint. The steel end caps evenly distributed the impact loads to the ends of the concrete beams, which significantly reduced damage. While the techniques and improvements described herein are presented in the context of a traffic barrier, it is contemplated that the improvements are applicable to other applications such as building construction, temporary barriers and the like.

Relative to the present disclosure, three variations of the ACJ were identified as possible modifications that could result in reduced concrete damage. The first variation incorporated rubber bearing pads between the steel angles and the concrete beams. The rubber pads were intended to better distribute the impact loads between the steel angle and the concrete beam ends, thereby reducing the propensity of concrete cracking. Additionally, the rubber pads had the potential to absorb some of the impact energy as they were compressed, which would also reduce stresses and cracking in the beams. Thus, ¼-in. (6-mm) thick neoprene pad was placed on both sides of each steel angle (front and back) of the ACJ.

The second joint variation utilized normal weight concrete instead of lightweight concrete. The beams were originally designed with lightweight concrete to limit the weight of the barrier, which reduced the barrier inertia and aided in the stability of the beam on the rubber posts. However, with the addition of the steel skids, the barrier weight was no longer critical to the stability of the system. Lightweight concrete typically has a lower shear strength than normal weight concrete. Thus, beams fabricated with normal weight concrete were expected to reduce the propensity of concrete cracking and spalling during loading. The lightweight concrete had an average density of 110 lb/ft$^3$ (1,762 kg/m$^3$) and an average compressive strength of 6,652 psi (45.9 MPa), while the normal weight concrete had an approximate density of 140 lb/ft$^3$ (2,243 kg/m$^3$) and a compressive strength of 7,022 psi (48.4 MPa).

The final ACJ joint variation incorporated normal weight concrete beams and a steel cap embedded into the ends of the concrete beam. In addition to the expected benefits of the normal weight concrete, the steel end cap confined the concrete in the ends of the beam, thereby increasing the concrete strength and resistance to cracking. Caps of any size and shape that is sufficient to at least partially cover an end of a concrete beam are contemplated in the present disclosure. In the particular embodiment illustrated, which is exemplary for the particular type of beam tested, the cap was designed as a 3/16-in. (5-mm) thick steel plate bent to match the shape of the end of the concrete beams. The cap was anchored to the beams with six steel shear studs and embedded into the beam at the time of casting. It should be appreciated that any number, arrangement or shape of studs can be used for the purpose of anchoring the cap into the concrete body of the beam. For example, studs with heads can be used, as is the case with the illustrated embodiments. Studs made from rebar having lateral engagement features in the concrete can also be used.

Four dynamic component tests were conducted to evaluate the performance of four variations of the joint design on the RESTORE barrier system. Each test incorporated two 20-ft (6.1-m) long RESTORE barrier concrete beam segments that were connected utilizing either the original ACJ or one of the three ACJ modifications discussed in Chapter 2. Each beam was supported by four rubber posts and two steel skids, in accordance with RESTORE barrier details. Two steel load frames located adjacent to the outermost rubber posts were utilized to laterally brace the test installations. Test nos. ACJB-1 and ACJB-2 utilized barrier segments made from lightweight concrete with a density of 110 lb/ft$^3$ (1,762 kg/m$^3$) and a compressive strength of 6,652 psi (45.9 MPa). The lightweight concrete beams were undamaged segments from the full-scale RESTORE barrier test installations. Test nos. ACJB-3 and ACJB-4 utilized normal weight concrete beams fabricated specifically for these component tests. The normal weight concrete had a density of 140 lb/ft$^3$ (2,243 kg/m$^3$) and a compressive strength of 7,022 psi (48.4 MPa). Between test nos. ACJB-1 and ACJB-2, the segments were rotated 180 degrees such that the outer ends of the segments were now at the joint location. The same beam rotation was conducted between test nos. ACJB-3 and ACJB-4. Thus, each concrete segment was utilized during two tests with each end being adjacent to the joint only once. A 5,000-lb (2,268-kg) bogie vehicle impacted the test installations 18 in. (457 mm) from the center of the joint between the two beam segments, creating a three-point bending test. The target impact conditions for all tests were a speed of 8 mph (13 km/h) and an angle of 90 degrees, or normal to the face of the longitudinal barrier. The test matrix is shown in Table 1 below:

| Test No. | Target Bogie Weight lb (kg) | Target Impact Speed mph (km/h) | Impact Angle (deg) | Concrete Segments | Joint Type |
|---|---|---|---|---|---|
| ACJB-1 | 5,000 (2,268) | 8 (13) | 90° | Lightweight Concrete | Standard ACJ |
| ACJB-2 | 5,000 (2,268) | 8 (13) | 90° | Lightweight Concrete | ACJ with Neoprene Pads |
| ACJB-3 | 5,000 (2,268) | 8 (13) | 90° | Normal Weight Concrete | Standard ACJ |
| ACJB-4 | 5,000 (2,268) | 8 (13) | 90° | Normal Weight Concrete | ACJ with Steel End Caps |

A rigid-frame bogie was used to impact the barrier system. The bogie head was constructed of a 6-in. thick×8-in. wide×24-in. tall (152-mm×203-mm×610-mm) timber post mounted to the front of the bogie. The timber impact head was bolted vertically to the front of the bogie frame so that contact would be made across the entire height of the concrete beam. The weight of the bogie with the addition of the impact head and accelerometers was 5,032 lb (2,282 kg). A pickup truck with a reverse-cable tow system was used to propel the bogie to a target impact speed of 8 mph (13 km/h). When the bogie approached the end of the guidance system, it was released from the tow cable, allowing it to be free rolling when it impacted the barrier system. A remote-control braking system was installed on the bogie, allowing it to be brought safely to rest after the test.

In all four dynamic tests, test nos. ACJB-1 through ACJB-4, the bogie vehicle and test installation interacted similarly. The majority of the impact force occurred early in the events as the momentum from the bogie vehicle was transferred into the system. Upon impact, the beams began to displace and the joints flexed. After a few inches of displacement, the bogie lost contact with the systems, but re-contacted the beams near the time of maximum deflection. Eventually, the system pushed the bogie vehicle backward as the rubber posts restored the beams to their original position. Although this general behavior was observed in all four tests, the magnitude of the deflections, forces, and damage to the test articles varied between tests, as described in the following sections.

The accelerometer data for each test was processed in order to obtain acceleration, velocity, and deflection curves, as well as force vs. deflection curves. Although the individual transducers produced similar results, the values described herein were calculated from the SLICE-1 data curves when available in order to provide common basis for comparing results from multiple tests. Additionally, the high-speed video of each test was analyzed to measure the displacements of three separate targets on the test installations: 1) at the impact point, 2) adjacent to the joint on the impacted barrier, and 3) adjacent to the joint on the non-impact barrier. The x- and y-coordinates of the targets were tracked in order to measure the lateral displacements of the beams as well as the longitudinal displacements of the joints (joint opening) as they flexed. The maximum lateral and permanent set displacements provided in the following sections were determined by the lateral movement of the targets adjacent to the joint.

Figure 9:
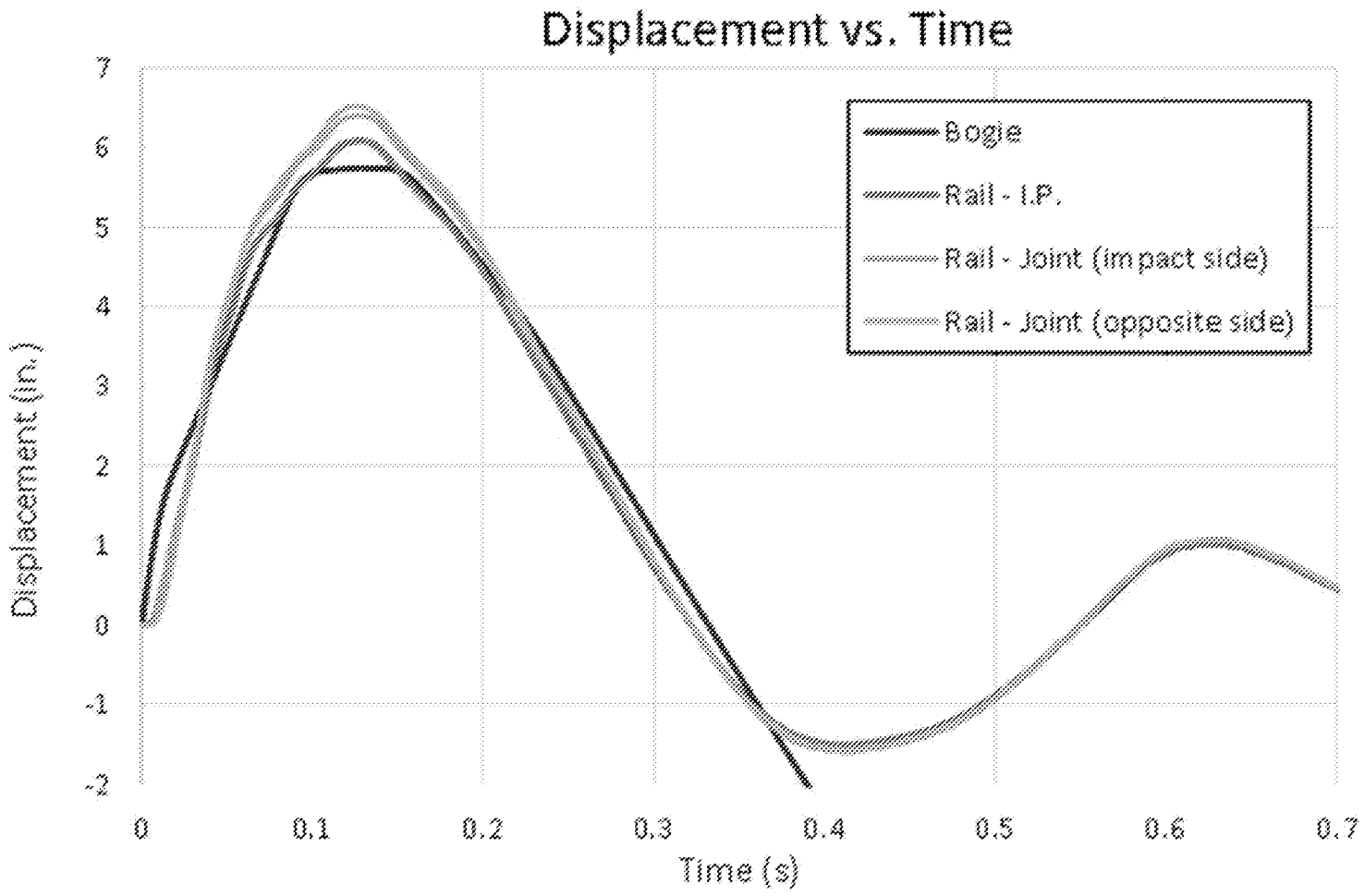

Test no. ACJB-1 was a baseline test to evaluate the current ACJ utilized in the RESTORE barrier with lightweight concrete beams. During test no. ACJB-1, the bogie impacted the test article 18 in. (46 cm) from the centerline of the joint at a speed of 8.4 mph (13.5 km/h). Upon impact, the concrete beams began to displace laterally, and the joint began to flex. A peak resistance force of 107.6 kips (479 kN) was recorded at 0.0072 s after impact. At 0.010 s and a lateral displacement of 0.23 in. (6 mm), a crack formed on the top surface of the impacted concrete beam near the back of the joint. At 0.028 s, the bogie lost contact with the rail as it continued to displace laterally. At 0.045 s and a displacement of 3.68 in. (93 mm), concrete cracking began on the opposite side beam near the back-side joint bolts. The bogie impacted the rail a second time at 0.077 s and again lost contact with it at 0.110 s. A maximum joint opening displacement of 0.30 in. (8 mm) occurred at 0.120 s, and the concrete beams reached a maximum lateral displacement of 6.52 in. (166 mm) at 0.122 s. As the test article began to restore to its initial position, the beam re-contacted the bogie at 0.140 s and began to push the bogie backward. The bogie lost contact with the system for a final time at 0.300 s with a velocity of −2.0 mph (−3.2 km/h) (away from the system). The rail rebounded to a permanent set displacement of 0.19 in. (5 mm). Displacement vs. time curves for the bogie and the system targets are shown in FIG. 9.

Damage to the test article included concrete cracking and fracture. The impacted beam had a 1/32-in. (1-mm) wide crack on the top surface extending from the rear ACJ bolt to the pentagon-shaped void in the beam, and a 1/8-in. (3-mm) wide crack on the bottom surface that extended laterally between the ACJ bolts. The non-impact beam had a 1/8-in. (3-mm) wide crack on its top surface that extended between the ACJ bolts. Also, an 11-in.×8-in.×2¾-in. deep (279-mm×203-mm×70-mm deep) concrete piece fractured off from the bottom of the beam adjacent to the joint. When the joint was disassembled, additional concrete pieces that fractured from the ends of the two beams fell to the ground. The majority of the concrete between the ACJ bolt holes on the ends of both beams had disengaged. The fracture surfaces extended about 3 in. (76 mm) into the ends of the beams and exposed rebar in both beams.

Figure 10:
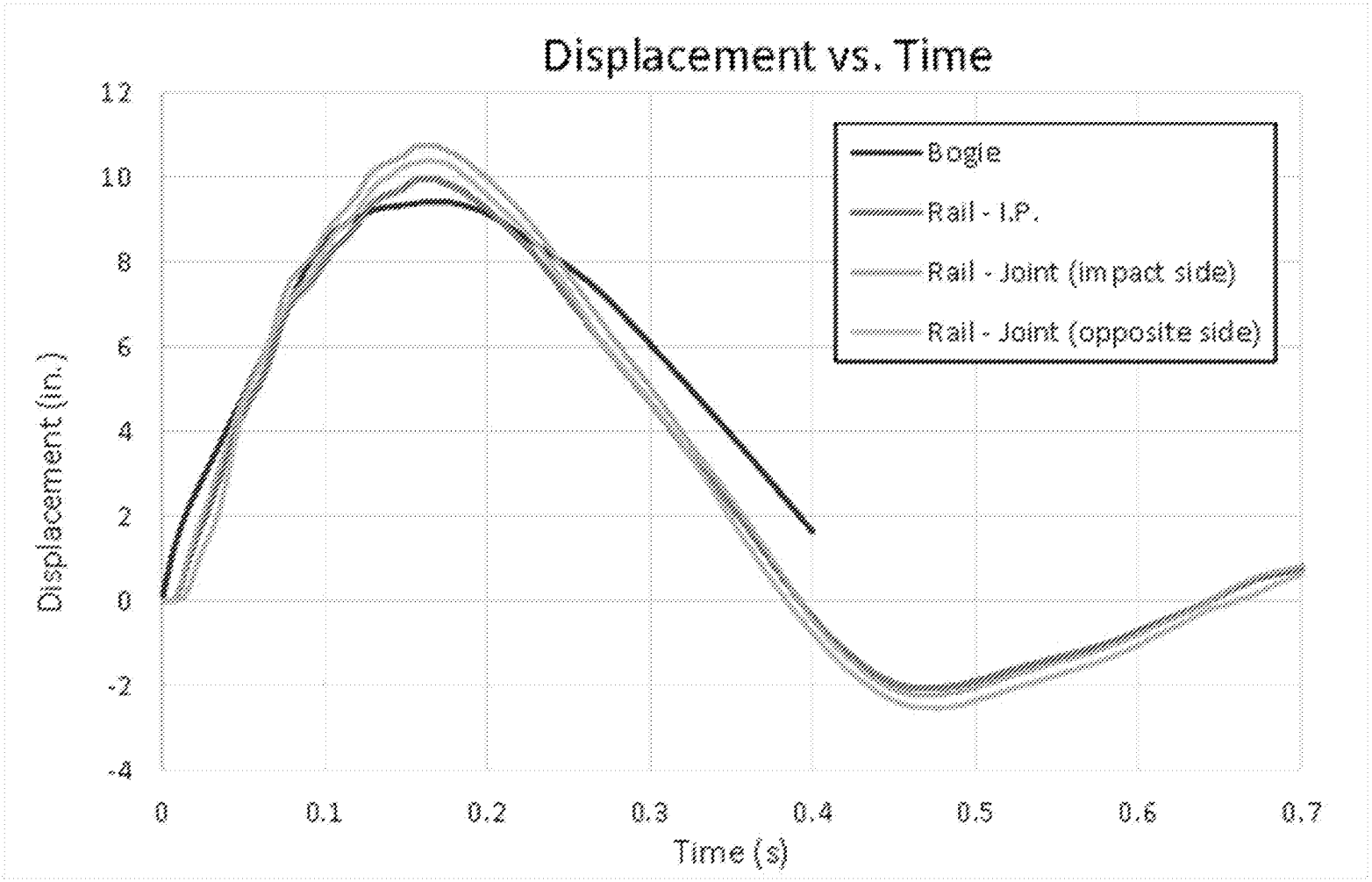

The concrete damage sustained by the beams during test no. ACJB-1 was similar to the damage observed during full-scale testing of the RESTORE barrier. Thus, it was determined that the 3-point bending test setup was loading the barrier joint in a similar manner to an impact on an actual system installation. Further, these results gave the researchers confidence that the remaining component tests on the modified ACJs would provide a reasonable estimation of system damage to the RESTORE barrier during actual vehicle impacts Test no. ACJB-2 evaluated the ACJ with neoprene bearing pads between the steel angles and the lightweight concrete beams. During test no. ACJB-2, the bogie impacted the test article 18 in. (46 cm) from the centerline of the joint at a speed of 10.2 mph (16.4 km/h). Upon impact, the concrete beams displaced laterally and the joint flexed. A peak resistance force of 115.3 kips (513 kN) was recorded at 0.0056 s after impact. At 0.024 s, the bogie lost contact with the rail as it continued to displace laterally. At 0.042 s and a lateral displacement of 3.81 in. (97 mm), a crack formed on the bottom surface of the impacted concrete beam between the front and back joint bolts. At 0.067 s and a displacement of 6.10 in. (155 mm), concrete cracking began on the bottom surface of the opposite side beam adjacent to the rear joint bolt. The bogie impacted the rail a second time at 0.084 s and lost contact with it a second time at 0.108 s. The maximum joint opening displacement of 0.66 in. (17 mm) occurred at 0.143 s, and the concrete beams reached a maximum lateral displacement of 10.74 in. (273 mm) at 0.162 s. As the test article began to restore to its initial position, the beam re-contacted the bogie at 0.252 s and pushed the bogie backward. The bogie lost contact with the system for a final time at 0.370 s with a velocity of −2.6 mph (−4.2 km/h) (away from the system). The rail rebounded to a permanent set displacement of 0.20 in. (5 mm). Displacement vs. time curves for the bogie and the system targets are shown in FIG. 10.

Damage to the test article consisted of concrete cracking and spalling. A 7-in. (178-mm) hairline crack on the top surface of the impacted barrier started adjacent to the back bolt location and extended forward into the beam. A 1/8-in. (3-mm) wide crack on the bottom surface of the impacted beam extended laterally between the ACJ bolt locations. A 1/16-in. (2-mm) wide crack extended between the bolts on the bottom of the non-impact beam. After the joint was disassembled, additional hairline cracks were found extending vertically between the bolt holes on the backside of both beams. Minor spalling was also present around nearly all of the bolt holes. The worst spalling occurred adjacent to the backside bolt holes on the opposite side beam, where it extended from the holes to the edge of the beam chamfer with a maximum depth of ½ in. (13 mm).

Figure 11:
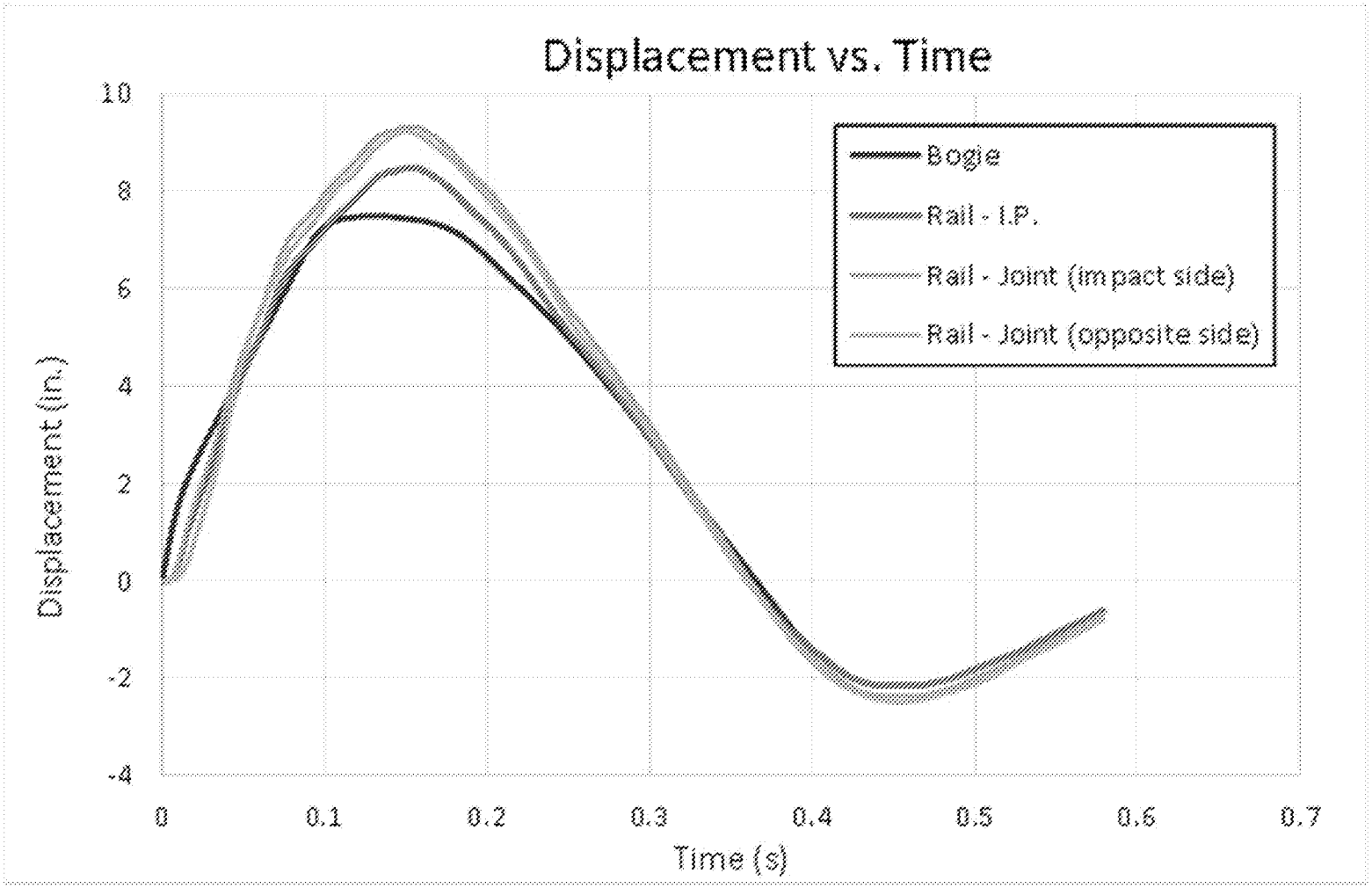

Test no. ACJB-3 evaluated the performance of the ACJ with normal weight concrete beams in lieu of the lightweight concrete beams of the as-tested version of the RESTORE barrier. During test no. ACJB-3, the bogie impacted the test article 18 in. (46 cm) from the centerline of the joint at a speed of 10.2 mph (16.4 km/h). Upon impact, the concrete beams displaced laterally and the joint flexed. A peak resistance force of 133.3 kips (593 kN) was recorded at 0.0073 s after impact. At 0.018 s and a lateral displacement of 1.26 in. (32 mm), a crack formed in the impacted concrete beam between the front and back joint bolts. At 0.032 s, the bogie lost contact with the rail as it continued to displace laterally. The bogie impacted the rail a second time at 0.090 s, and concrete cracking began on the top surface of the opposite side beam adjacent to the rear joint bolt at 0.093 s and a displacement of 7.31 in. (186 mm). The bogie lost contact with the beam for a second time at 0.110 s. The maximum joint opening displacement of 0.71 in. (18 mm) occurred at 0.152 s, and the concrete beams reached a maximum lateral displacement of 9.32 in. (237 mm) at 0.153 s. As the test article began to restore to its initial position, the beam re-contacted the bogie at 0.170 s and pushed the bogie backward. The bogie lost contact with the system for a final time at 0.330 s with a velocity of −2.6 mph (−4.2 km/h) (away from the system). The rail rebounded to a permanent set displacement of 0.46 in. (12 mm). Displacement vs. time curves for the bogie and the system targets are shown in FIG. 11.

Damage to the test article consisted of concrete cracking and fracture. Concrete spalling occurred on the front of the impacted beam adjacent to the chamfered end. A concrete piece measuring about 7 in. (178 mm) wide and 2½ in. (64 mm) deep was observed on the top surface of the impacted barrier adjacent to the back joint bolt. A larger concrete piece measuring 12 in.×13 in.×3 in. deep (305 mm×330 mm×76 mm deep) disengaged from the impacted barrier and exposed the internal rebar on the bottom half of the beam end. Minor spalling and hairline cracks were observed on the top of the non-impact beam adjacent to the back joint bolt. After the joint was disassembled, further spalling and concrete disengagement around the bolt holes on the end surfaces of the beams were observed. Two 1/16-in. (2-mm) wide cracks extended from the top to the bottom of the opposite side beam through the back bolt holes. A 1/32-in. (1-mm) wide crack originated from the top-back bolt hole and extended across the end surface of the opposite side beam.

Figure 12:
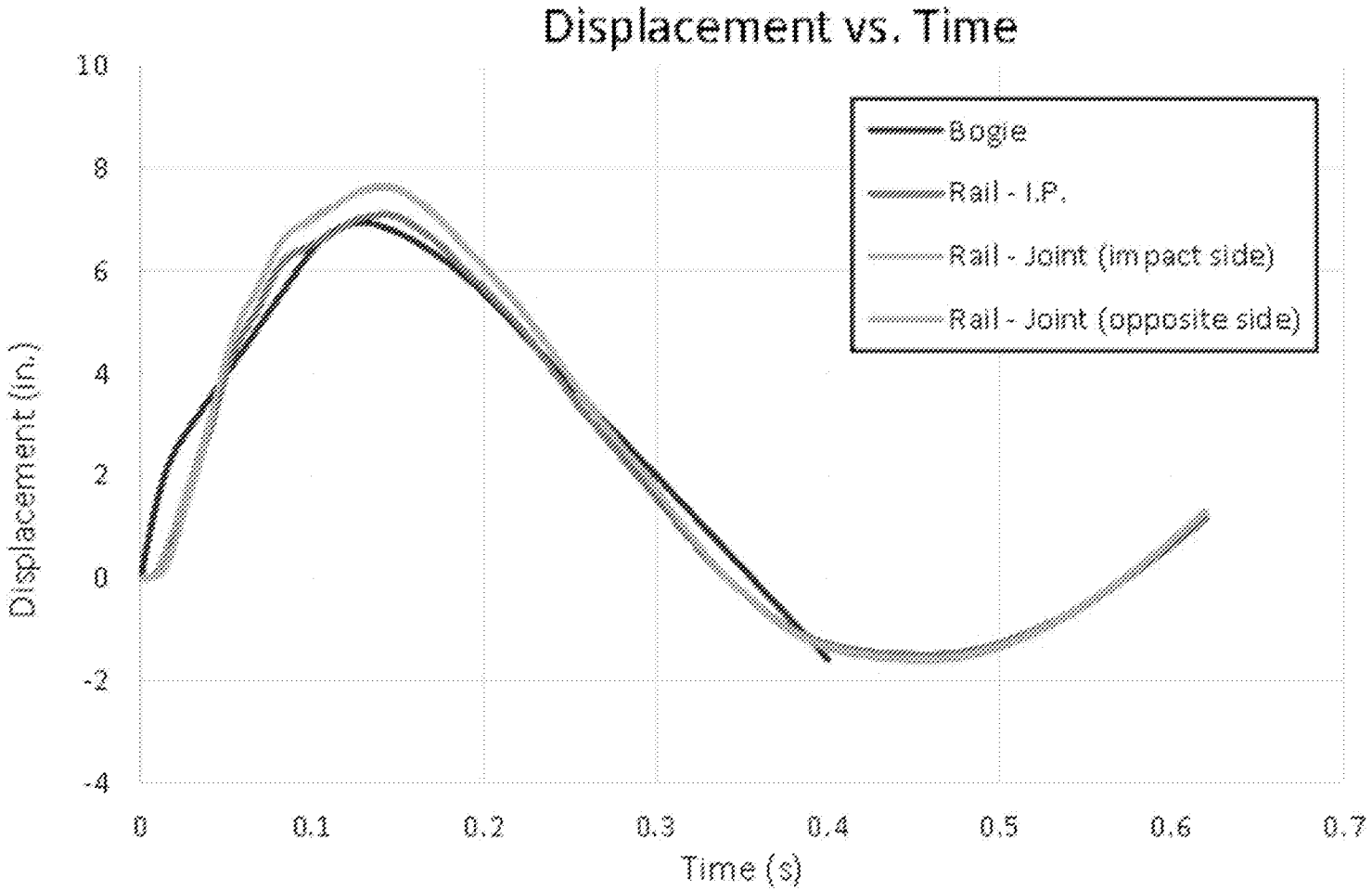

Test no. ACJB-4 evaluated normal weight concrete beams with steel end caps. During test no. ACJB-4, the bogie impacted the test article 18 in. (46 cm) from the centerline of the joint at a speed of 9.9 mph (15.9 km/h). Upon impact, the concrete beams displaced laterally and the joint flexed. A peak resistance force of 96.9 kips (431 kN) was recorded at 0.0076 s after impact. At 0.028 s, the bogie lost contact with the rail as it continued to displace laterally. At 0.061 s and a lateral displacement of 5.15 in. (131 mm), a crack formed on the top surface of the impacted concrete beam near the rear joint bolt. The bogie impacted the rail a second time at 0.095 s, and concrete beams reached a maximum lateral displacement of 7.66 in. (195 mm) at 0.136 s. The bogie lost contact with the beam a second time at 0.145 s. As the test article began to restore to its initial position, the beam re-contacted the bogie at 0.180 s and pushed the bogie backward. The bogie lost contact with the system for a final time at 0.330 s with a velocity of −2.0 mph (−3.2 km/h) (away from the system). The maximum joint opening displacement of 0.12 in. (3 mm) occurred at 0.463 s when the test article reached its maximum forward displacement and began to return to its initial position. The rail rebounded to a permanent set displacement of 0.70 in. (18 mm). Displacement vs. time curves for the bogie and the system targets are shown in FIG. 12.

Damage to the test article consisted of minor concrete cracking. A 1/32-in. (1-mm) wide crack on the top surface of the impacted barrier began near the back joint bolts and extended toward the front of the beam. The non-impact barrier had a hairline crack at the same location that extended 2 in. (51 mm) toward the pentagon-shaped void in the beam. No further damage was observed after the joint was disassembled as the steel end cap remained undamaged.

The general behavior of each test installation was similar among test nos. ACJB-1 through ACJB-4. Upon impact from the bogie vehicle, the joints flexed and allowed the concrete beams to displacement laterally. After absorbing the impact energy from the bogie vehicle, the elastic strain energy in the joints and rubber posts caused the beams to restore to nearly their initial positions. However, the ACJ design variations created differences in beam displacement, event duration, and sustained damage. A summary of the component testing results is shown in Table 2 below. Note that peak forces and system displacements were dependent upon the impact speed, or impact energy, of the bogie vehicle. To provide a better comparison of the strength and stiffness of each ACJ variation, the maximum displacement of the target adjacent to the joint was normalized by dividing by the impact energy, as shown in Table 2:

| | Test No. | | | |
|---|---|---|---|---|
| | ACJB-1 | ACJB-2 | ACJB-3 | ACJB-4 |
| Impact Velocity (mph) | 8.4 | 10.2 | 10.2 | 9.9 |
| Bogie Weight (lb) | 5,032 | 5,032 | 5,032 | 5,032 |
| Maximum Displacement (in.) | | | | |
| Bogie | 5.74 | 9.42 | 7.49 | 6.94 |
| Rail @ Impact Point | 6.09 | 9.95 | 8.48 | 7.10 |
| Rail @ Joint | 6.52 | 10.74 | 9.32 | 7.66 |
| Rail Disp./Impact Energy (in./kip-ft) | 0.549 | 0.618 | 0.535 | 0.467 |
| Permanent Set (in.) | 0.19 | 0.20 | 0.46 | 0.70 |
| Exit Velocity (mph) | −2.05 | −2.60 | −2.57 | −2.06 |
| Peak Force (kips) | 107.6 | 115.3 | 133.3 | 96.9 |
| Event Duration (s) | 0.300 | 0.370 | 0.330 | 0.330 |
| First Cracking - Impacted Barrier | | | | |
| Time (s) | 0.010 | 0.042 | 0.018 | 0.061 |
| Lateral Joint Displacement (in.) | 0.23 | 3.81 | 1.26 | 5.15 |
| First Cracking - Non-Impact Barrier | | | | |
| Time (s) | 0.045 | 0.067 | 0.093 | NA |
| Lateral Joint Displacement (in.) | 3.68 | 6.10 | 7.31 | NA |
| Joint Opening Width | | | | |
| Initial Gap Width (in.) | ¾ | ½ | ½ | ½ |
| Maximum Displacement (in.) | 0.30 | 0.66 | 0.71 | 0.12 |
| Permanent Displacement (in.) | 0.03 | 0.14 | 0.56 | 0.08 |
| Damage Scale | Severe | Minor | Heavy | Minimal |

While reviewing high-speed data, it was observed that all of the concrete cracking appeared to initiate at the backside of the joints adjacent to the bolts. As the beams displaced, the tension bolts (back side) were loaded and may have shifted and pressed against the sides of the bolt hole. The buildup of large shear forces against the side of holes likely led to stress concentrations and eventual cracking. The internal steel reinforcement limited cracks from propagating toward the middle of the beams, but the outer 3 in. (76 mm) of concrete at the end of the beam was susceptible to crack propagation and eventual fracture. Thus, the cracks tended to propagate adjacent to the rebar cage near the end of the beam and eventually reached the bolt holes in the front of the beams.

Although cracking was initiated in the same manner among all of the test articles, the amount of concrete damage sustained at the ends of the beams differed. Test nos. ACJB-1 and ACJB-3 displayed the worst damage as concrete pieces fractured off of the ends of the beams and exposed the internal steel reinforcement. This type of concrete damage was observed in the full-scale testing of the RESTORE barrier, and preventing such damage was the purpose of this study. The use of normal weight concrete in test no. ACJB-3 reduced the amount of concrete cracking, spalling, and fracture in the beams as compared to the baseline test with lightweight concrete in test no. ACJB-1. Additionally, the onset of cracking in the normal weight concrete beams was delayed about twice as long as in the lightweight concrete beams. Thus, the normal weight concrete barriers would be less likely to sustain damage during low severity impacts. However, the cracking and fracture sustained during test no. ACJB-3 suggests that maintenance would likely still be required after moderate to severe impacts.

The rubber bearing pads utilized in test no. ACJB-2 resulted in a more flexible joint and allowed increased system displacements, illustrated by test no. ACJB-2 having the highest displacement per impact energy value. The increased flexibility allowed for a longer impact event and delayed the onset of concrete cracking compared to the baseline test. Additionally, the bearing pad may have distributed the impact loads more evenly across the joint and prevented stress concentrations and localized cracking. The combination of these factors caused by the introduction of rubber bearing pads within the ACJ resulted in greatly reduced concrete damage to the system beams.

The steel end cap utilized in test no. ACJB-4 provided the best durability and resistance to damage among the joint variations evaluated herein. The steel end cap provided a smooth bearing surface for the angled joint pieces and confinement strength to the concrete in the ends of the beams. Thus, only minor hairline cracks were observed during test no. ACJB-4. The increased strength of the system also increased the stiffness of the joint. Test no. ACJB-4 had the lowest displacement per impact energy and the lowest joint opening displacement among all four tests. Test no. ACJB-4 had the largest permanent set value, but the final displacement was still less than ¾ in. (19 mm) from its original position and was not a concern.

Referring generally to FIGS. 1 through 12, energy-absorbing, restorable traffic barrier systems are described. Coupling assemblies for connecting adjacent prefabricated structural elements end-to-end are also described. In some embodiments, the coupling assembly is an adjustable continuity joint (ACJ) that allows prefabricated structural elements (e.g., rigid or semi-rigid segments) that can be made from various materials (e.g., concrete, plastic, or other composite material) to have continuity when assembled. For example, prefabricated structural elements have manufacturing tolerances that allow products to vary from nominal details. Using the systems and techniques described herein, manufacturing and installation tolerances can allow the widths of gaps between prefabricated segments to vary. Further, an ACJ can account for these tolerances while still providing continuity between adjacent segments.

As described herein, an ACJ can be used to connect adjacent structural elements together. In some embodiments, the structural elements can be beams, such as precast concrete beams/panels, wooden beams/panels, fiber-reinforced plastic (FRP) elements, steel elements, and so on. However, beams are provided by way of example and are not meant to limit the present disclosure. In other embodiments, an ACJ can be used to connect other structural elements together, including, but not necessarily limited to, panels, such as wall panels for a building, noise wall panels for a roadside system, other wall panels, deck panels, bridge girders, building beams, an any other barrier, wall, or supportive structures.

Figure 1:
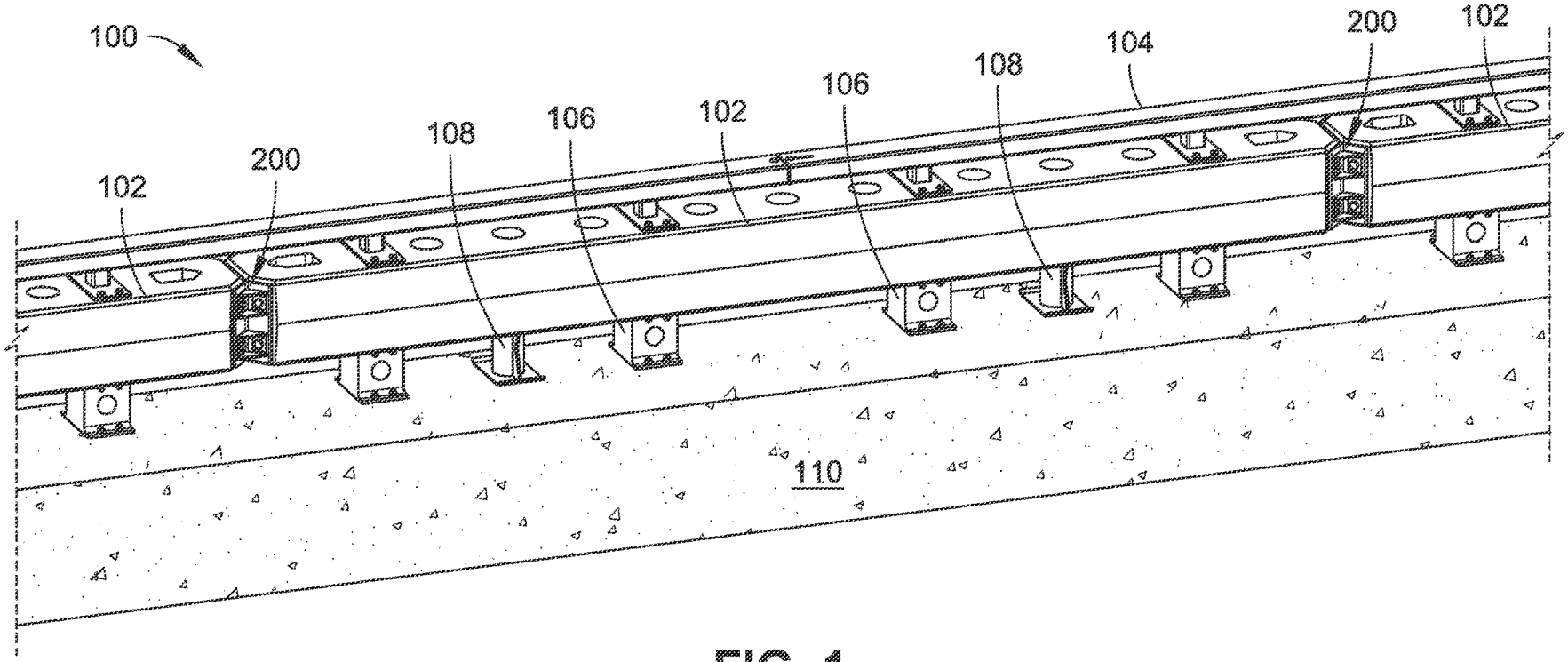
FIG. 1 is an isometric view of the barrier system implemented in accordance with an embodiment of this disclosure.
Figure 2:
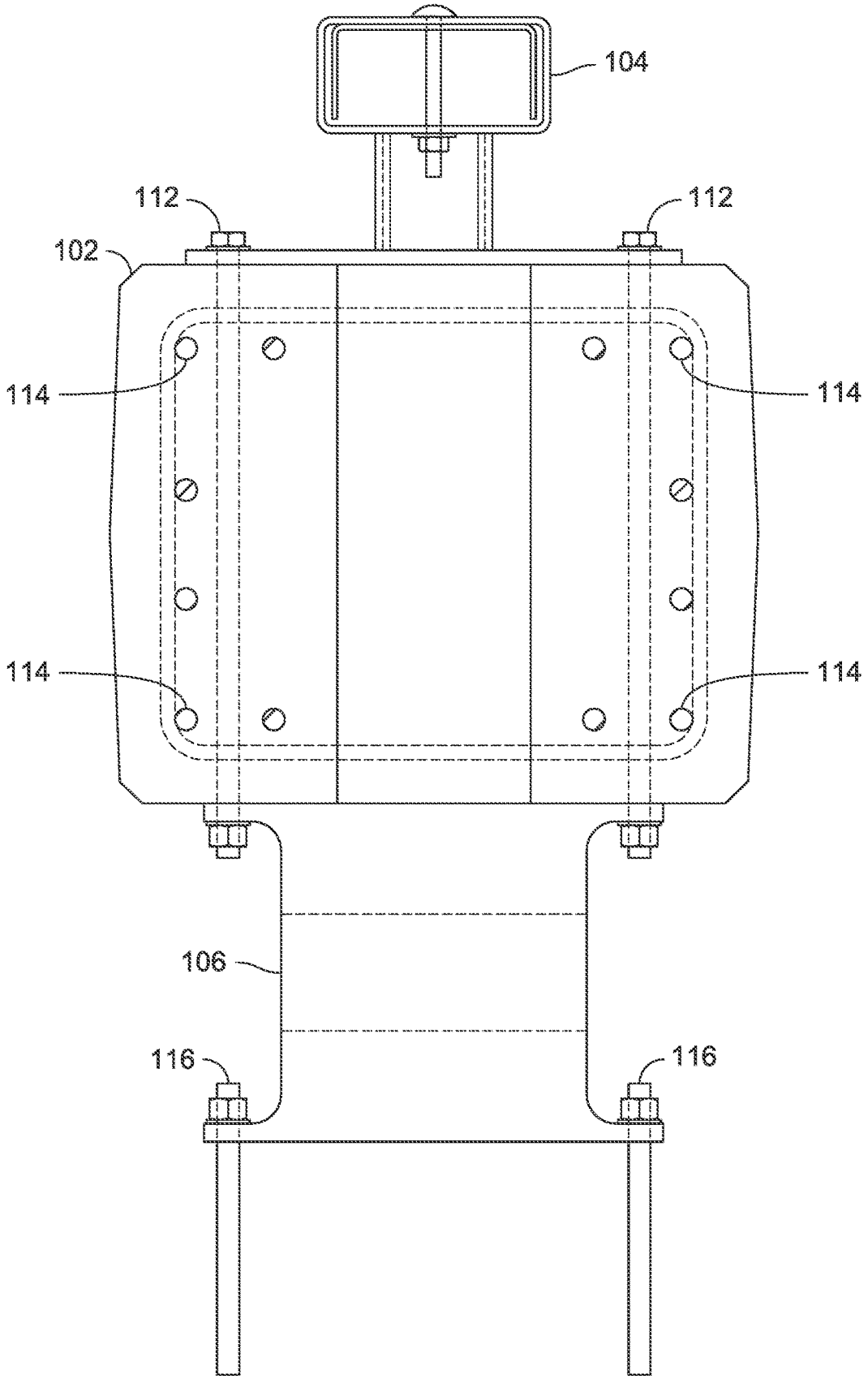
FIG. 2 is an end view of a barrier segment for a barrier system, in accordance with an embodiment of this disclosure.

FIG. 1 shows a coupling assembly 200 implemented for a barrier system 100, in accordance with an embodiment of this disclosure. As shown, the barrier system 100 can include two or more barrier segments 102, referring generally to the precast concrete, plastics, and/or metal segments of the system 100. The barrier segments 102 can be coupled together by coupling assemblies 200 (e.g., ACJs) that couple the barrier segments 102 end-to-end, as discussed in further detail below. A shown in FIG. 2, each barrier segment 102 can have at least one end with drilled, cast or otherwise formed holes 114 which may have screw anchors or nuts disposed therein or accessible therethrough for attaching to the coupling assembly 200. In some embodiments, the barrier segments 102 may also be coupled to a railing 104 that extends over the tops of some or all of the barrier segments 102. The railing 104 can also couple the barrier segments 102 together and may also be at a height that makes it more visible to a driver, thus enabling them to maintain an adequate distance from the barrier segments 102. For example, FIG. 2 shows an end view of the railing 104 attached to the barrier segment 102 by fasteners 112. Fasteners can include, but are not limited to, bolts, threaded couplings, mechanical wedges/anchors, and the like.

Figure 3:
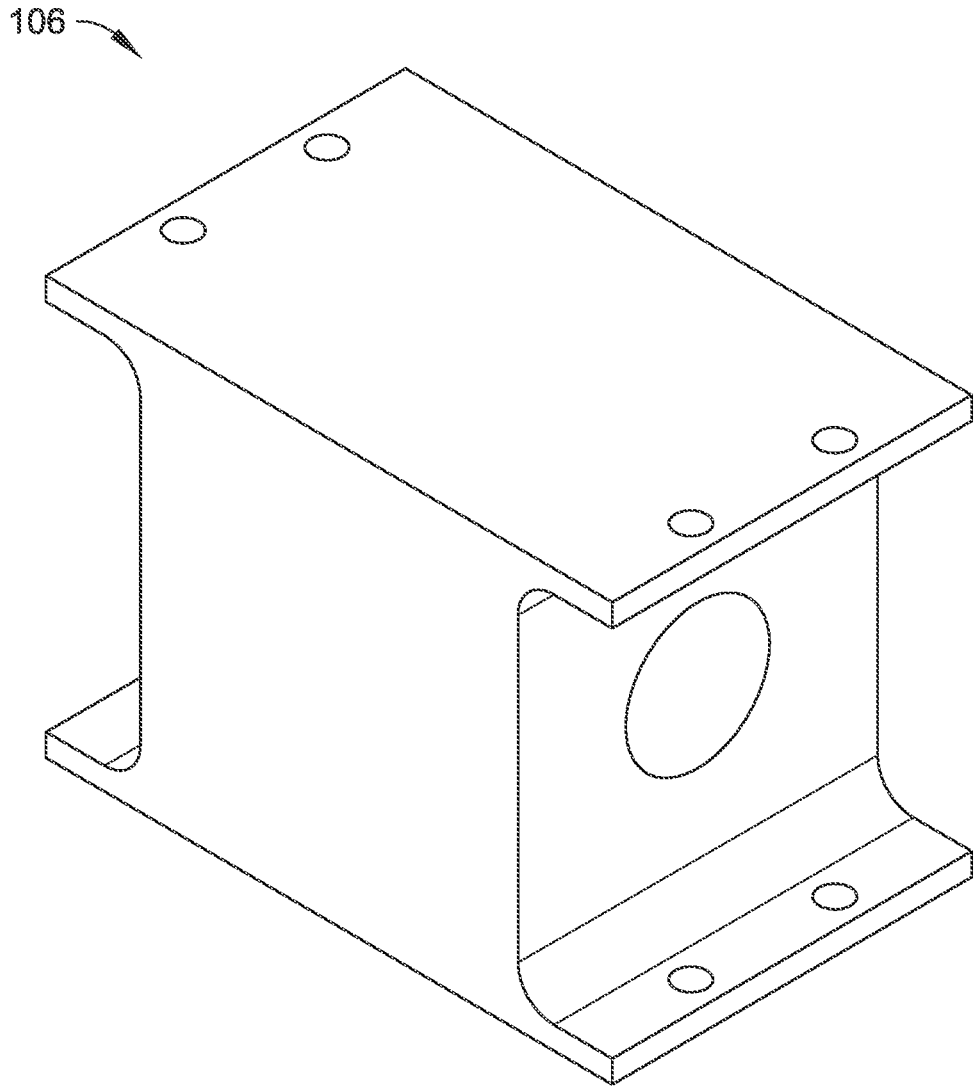
FIG. 3 is an isometric view of an elastically-deformable support for the barrier system, in accordance with an embodiment of this disclosure.
Figure 4:
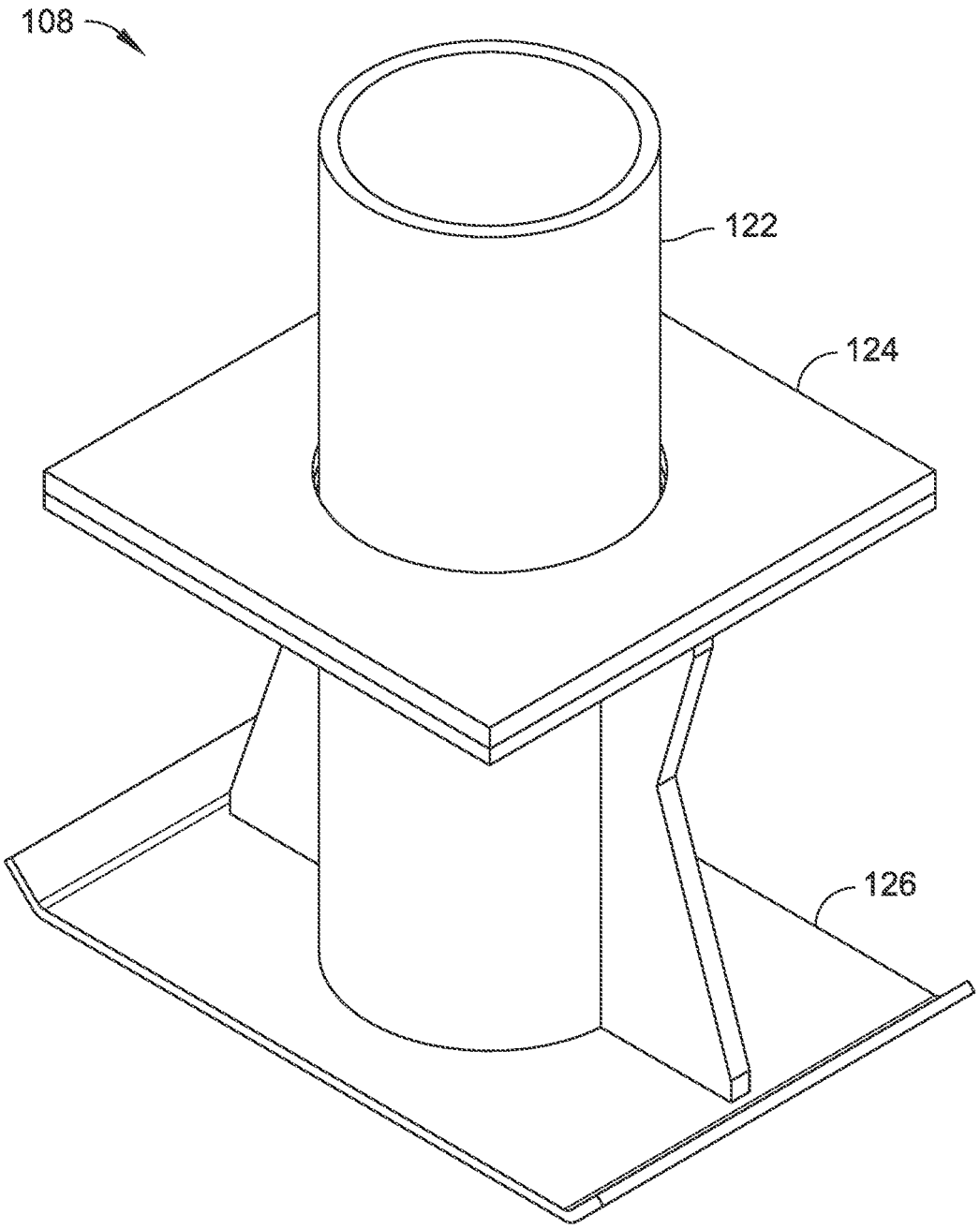
FIG. 4 is an isometric view of a ski assembly for the barrier system, in accordance with an embodiment of this disclosure.
Figure 5:
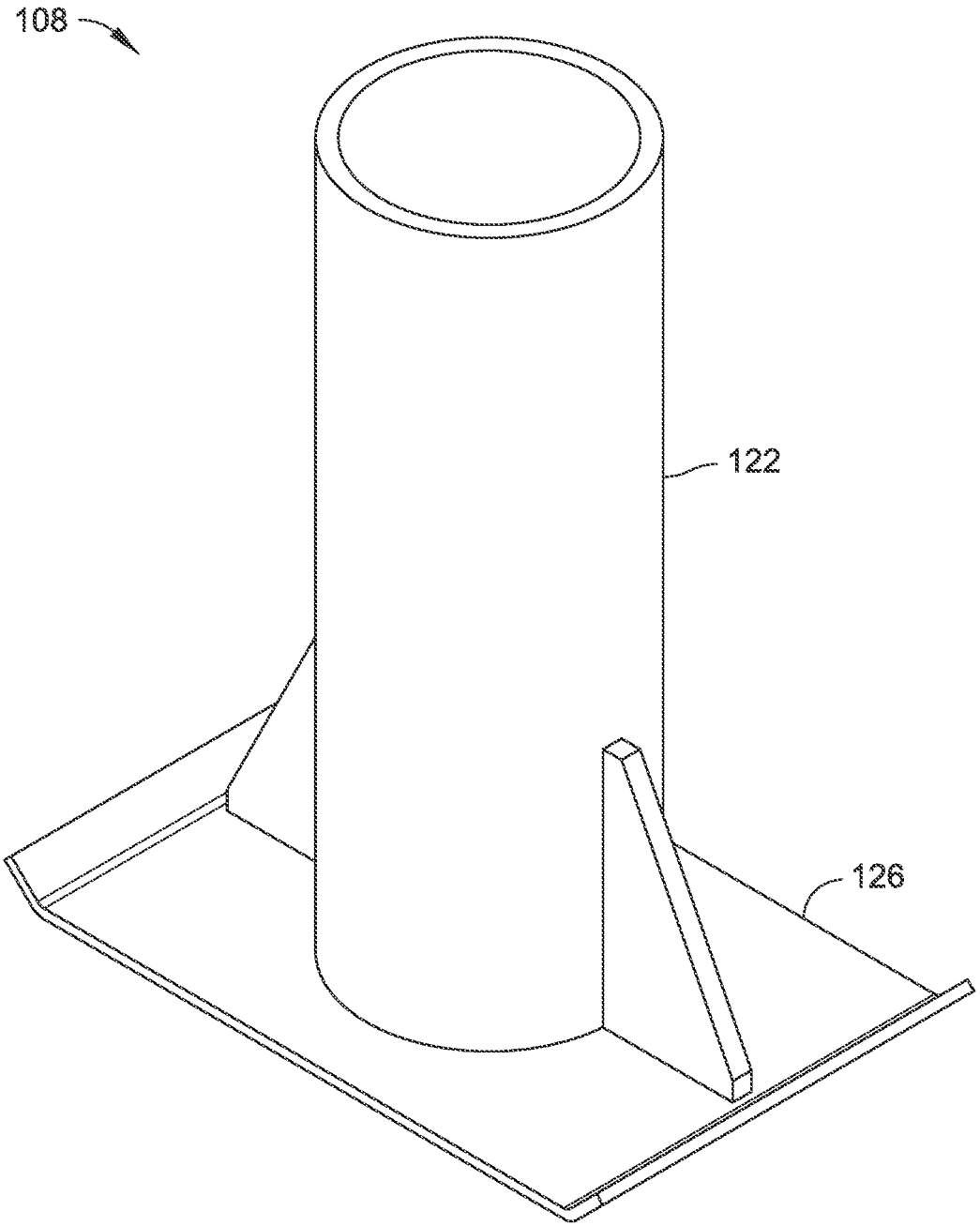
FIG. 5 is an isometric view of a ski assembly for the barrier system, in accordance with an embodiment of this disclosure.

In some embodiments, the barrier segments 102 are supported above a support surface 110 (e.g., above the ground) by support structures 106. The support structures 106 may be fastened to (e.g., bolted into or otherwise coupled to) the support surface 110 with fasteners 116 as shown in FIG. 2. In some embodiments, the support structures 106 are elastically-deformable supports (e.g., as shown in FIG. 3 and described in further detail below). Sliding posts 108 (e.g., ski-like structures as shown in FIGS. 4 and 5) can also be disposed between the barrier segments 102 and the support surface 110, where the sliding posts 108 can slide laterally upon the support surface 110 and provide secondary support to prevent the barrier segments 102 from overturning. For example, this may occur when any of the elastically-deformable support structures 106 are deformed as a result of a high impact.

Figure 6:
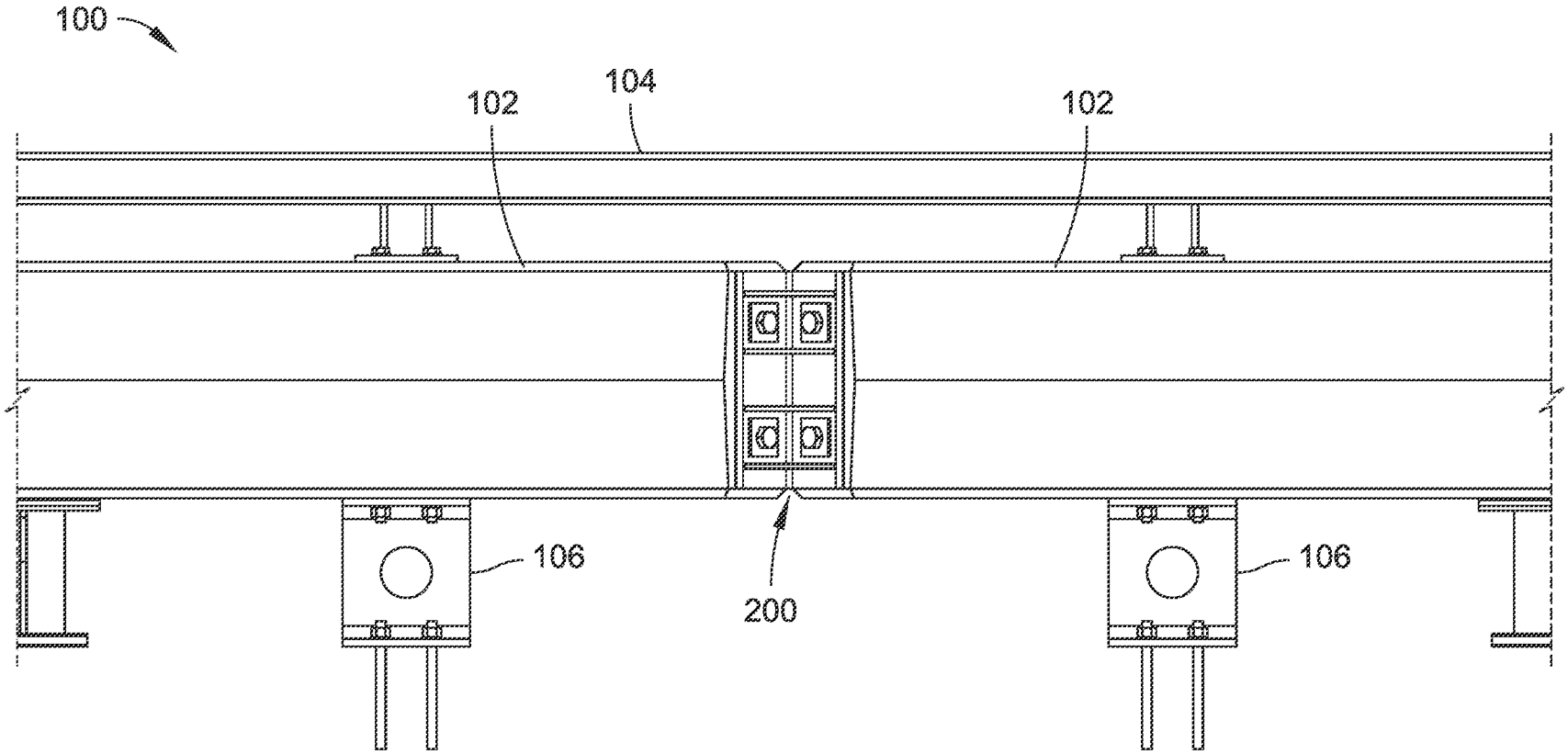
FIG. 6 is a side view showing the barrier system with a coupling assembly for connecting barrier segments of the barrier system, wherein the coupling assembly connects angled facets of the barrier segments with one another at a notch-shaped (e.g., V-shaped) interface, in accordance with an embodiment of this disclosure.

FIG. 6 is a side view showing a coupling interface between two barrier segments 102. In some embodiments, the barrier system 100 includes two or more barrier segments 102 (e.g., concrete or high density material block, beam, panel, or the like) having angled faces 118 at respective ends of the barrier segment 102. The coupling assembly 200 (e.g., sometimes referred to herein as the "ACJ") connects a first angled face 118 of a first barrier segment 102 to a second face 118 of a second barrier segment 102, and so on. Any number of barrier segments 102 can be connected in this fashion. In some embodiments, the ACJ 200 comprises a wedge-shaped or "V-shaped" connector 202 (e.g., as shown in FIG. 8) that adjoins prefabricated barrier segments 102 end-to-end. For example, top plan views of three alternative embodiments for a coupling interface is are shown in FIGS. 7A-7C. The ACJ 200 can be used on both the front and back sides of the barrier segments 102 (e.g., in the direction of loading).

In reference to FIGS. 7A-7C, where like reference numerals denote like or similar structures for simplicity, the wedge-shaped connector 202 employs a geometry that fits the end geometry of the barrier segments 102. For example, the connector 202 simultaneously contacts the first angled face 118 of the first barrier segment 102 and the second angled face 118 of the second barrier segment 102. As shown in the figures, the first and second angled faces 118 are disposed at 45 degrees and 315 degrees relative to a longitudinal axis of the barrier segment, when measured in the same direction or, stated differently, at +45 deg. and −45 deg. relative to the longitudinal axis such that, when opposing angled faces from adjacent barrier segments meet, a 90 degree angle is formed between them, but other angles can be used. In general, when measured in the same direction, if one angled face is disposed at an angle, a, the other angled face will be disposed at an angle of (360 deg.−$\alpha$), such that the opposing faces on adjacent barrier segments meet and form an angle of (2$\alpha$) therebetween.

In some embodiments, the ACJ 200 uses slots with a wedge-shape connector 202 that allows it to slide inward toward the barrier segments 102 when there is a large gap, and outward away from the barrier segments 102 when there is a small gap. Fasteners 204 can be installed perpendicular to and extending through the wedged connector 202 and angled face 118 on the ends of the barrier segments 102. The barrier segments 102 can also have internal angled faces 120 for receiving the fasteners 204 that secure the connector 202 to outer angled faces 118. In some embodiments, a cover can be used to provide an aesthetic and/or closed joint (e.g., to prevent other objects, such as vehicles, from contacting and/or snagging within the joint and/or on the upstream end of the second longitudinally extending beam).

In some embodiments, the ACJ 200 can be used with a barrier system 100 in which rectangular-shaped, precast concrete beams 102 are connected to one another end-to-end. However, this configuration is provided by way of example only and is not meant to limit the present disclosure. In other embodiments, the ACJ 200 can be used to furnish continuity across joints in other various applications, including, but not necessarily limited to the fabrication of other structural elements, e.g., with materials such as concrete, steel, timber, plastic, aluminum, and so forth. In some embodiments, an ACJ can be used with other precast barrier systems, and/or in other applications, such as in buildings and bridges.

In the first alternative embodiment shown in FIG. 7A, an elastic pad 700 is disposed between the mating surfaces of the barrier segments 102 and the v-shaped connectors 202. Particularly, the pads 700 are sandwiched between the angled faces 118 of the barrier segments 102 and outer orthogonal faces 206 of the connectors 202. The pads 700, which may be made of rubber, neoprene or another suitable material that can absorb mechanical strain while being of a composition that can withstand heat, humidity and other environmental effects, are disposed to at least partially cover the flat engagement surfaces between the angled faces 118 and the outer orthogonal faces 206. As shown in FIG. 8, the outer orthogonal faces 206 are defined on an L-shaped wall 208 of each connector 202. The wall 208, which is angled to matingly engage the angled faces 118, forms openings 210 to accommodate bolts 204. The openings extend through the walls 208 from an inner surface 212 to the outer surface 206. Strengthening ribs 214 are disposed between adjacent sets of openings 210. During operation, the pads 700 operate to absorb crash energy as discussed above.

In the second alternative embodiment shown in FIG. 7B, a metal cap 702 is cast into the ends of each barrier segment 102. The metal cap 702, which is also shown in FIG. 13, is made from steel plate and is shaped in a tri-fold configuration such that it can be externally molded onto the end of each barrier and form the angled surfaces 118. It should be appreciated that the end cap may alternatively be made from other materials including metals such as aluminum, galvanized steel and the like, or composites such as thermoplastic materials, fiberglass and the like. In the illustrated embodiment, the cap 702 is formed by a central panel 704 and two angled panels 706 connected on either side of the central panel 704. The central panel 702 includes two sets of studs 708 and protrude on an inner side thereof such that the studs 708 are embedded into the concrete used to form the barrier 102 upon casting. Similarly, studs 708 are placed on the angled panels 706. When cast into the end of the barrier 102, the studs 708 operate to rigidly retain the cap 702 onto the end of the barrier 102. Openings 710 formed in the angled panels 706 accommodate the bolts 204. As shown in FIG. 7B, the connector 202 abuts the angled panels 706 of the caps 702 of adjacent barriers 102 when assembled.

In the third alternative embodiment, a pad 700 is assembled between the connectors 202 and the caps 702. It is noted that, as described above, the concrete used to cast the barriers 102 can be full-weight concrete rather than light-weight concrete, in any of the embodiments shown in FIGS. 7A through 7C.

The coupling assemblies can be assembled in different known configurations as described, for example, copending U.S. application Ser. No. 15/096,889, which is incorporated herein in its entirety by reference. For example, a barrier system with a coupling assembly for connecting barrier segments 102 together end-to-end, where the coupling assembly comprises a splice plate secured by fasteners to the ends of barrier segments can be used. Additionally, a coupling assembly may comprise a splice tube system, where the barrier segments are notched, and rectangular support tubes are inserted into the notches and secured with fasteners. In yet another example, a coupling assembly can include an X-connection system having fasteners extending through drill holes made diagonally through the barrier segments such that at least a first fastener is transverse to a second fastener when both are inserted fully through the barrier segments, each fastener extending through at least a portion of the first barrier segment and also through at least a portion of the second barrier segment.

Regarding the embodiments described herein, and with reference to FIGS. 1 through 5, energy-absorbing, restorable traffic barrier systems 100 can employ sliding support posts 108 (e.g., ski-like support posts) to the barrier segments 102. The sliding posts 108 can allow the barrier to translate during impact events with limited barrier rotations and then restore to its original position. As shown in FIGS. 4 and 5, the sliding post 108 can include a support member 122 (e.g., having a circular cross-section as shown, or rectangular or other geometry in some cases) with a skid plate-like base structure 126 that slides on the support surface 110 when the sliding post 108 is tilted from an impact force on the barrier segment 102. The sliding posts 108 can be used with a barrier system 100 in which rectangular-shaped, precast concrete beams 102 are supported by elastically-deformable supports 106 (e.g., rubber posts, blocks, etc.) and also partially supported by the sliding posts 108 (e.g., steel skis or the like). Due to the large weight of the barrier segments 102 (e.g., precast concrete beams) used in the barrier system 100, the sliding posts 108 can be used to support part of the weight of the barrier segment 102 and allow it to slide laterally, which allows the elastically-deformable supports 106 to deflect and absorb energy during vehicle impact events and then restore. Not only can the sliding posts 108 help support the rail weight and slide with the barriers, the wide base 126 of the sliding post 108 may also prevent the system 100 from excessively rotating backward when impacted. For attachment to an energy-absorbing traffic barrier segment 102, the support member 122 of the sliding post 108 can be inserted into prefabricated holes placed vertically through the barrier segment 102 and/or attached to the bottom of the barrier segment 102.

In some embodiments, the sliding post 108 can also include a support platform 124 that helps support the barrier segment 102 when the barrier segment 102 is placed upon the sliding post 108. For example, shelves 124 (e.g., as shown in FIG. 4) can be attached to the support members 122 at approximately the same height of the elastically-deformable supports 106, which can allow barrier segments 102 to rest on top of the shelves 124 at a desired height. Rubber or neoprene bearing pads can also be inserted between the shelf 124 and the bottom of the barrier segment 102 to allow for adjustability in system height due to construction tolerances and/or changes in site conditions, such as vertical curvature of the roadway. It should be noted that sliding posts 108 described herein may also have applicability in other traffic safety barriers that may benefit from a post that can support the weight of rail elements, translate laterally, and restore during and/or after vehicle impact events, and prevent the barrier system from rotating excessively.

In some embodiments, the sliding posts 108 can support most of the weight of barrier segments 102 but can still allow the barrier system 100 to deflect and restore freely. In some embodiments, the support member 122 of the sliding post 108 can be round steel tubing that fits snugly into the lower portion of vertical holes in the barrier segments 102. However, round tubing is provided by way of example and is not meant to limit the present disclosure. In other embodiments, differently shaped tubing structure and/or holes can be used, including, but not necessarily limited to: rectangular-shaped tubing and/or holes, square shaped tubing and/or holes, octagonal-shaped tubing and/or holes, and so forth. In some embodiments, sliding posts 108 may not necessarily support the weight of the barrier segments 102 (e.g., primarily serving to provide lateral stability). In this example, one or two, or more, sliding posts 108 may be placed under one barrier segment 102, providing a stable system. In some embodiments, elastically-deformable supports 106 and sliding posts 108 can both be used to support most of the weight of the barrier segments 102 (e.g., as shown in FIG. 1). Since site terrain may not be completely level, shims (e.g., rubber and/or steel shims) can be installed between the support member 122 of the sliding post 108 and the bottom of the barrier segment 102.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A barrier system, comprising:

a first barrier segment having a first angled face and comprising an essentially solid interior, the first barrier segment having a generally elongate shape that extends along a longitudinal axis, the first angled face including:

a first flat face extending perpendicularly to the longitudinal axis, and two first angled side faces disposed on opposing sides of the first flat face;

a second barrier segment having a second angled face and comprising a second essentially solid interior, the second barrier segment having a generally elongate shape that extends along the longitudinal axis, the second angled face including:

a second flat face extending perpendicular to the longitudinal axis and parallel to the first flat face, and two second angled side faces disposed in opposed relation to the two first angled side faces;

a pair of wedge-shaped connectors disposed, one each, in contact with opposing pairs of first and second angled side faces;

a pair of elastic pads disposed, one each, in contact between each of the pair of wedge-shaped connectors and a corresponding opposing pair of first and second angled side faces, the pair of elastic pads each conforming in shape to the wedge-shaped connectors and spacing the first and second flat faces from one another; and at least one fastener disposed between each of the pair of wedge-shaped connectors and each of the first and second angled side faces, each of the at least one fasteners passing through only one angled side face of only one angled face of one of the first or second barrier segments and a portion of the corresponding essentially solid interior and, after passing through the portion of the corresponding essentially solid interior, being secured at an opening in the corresponding essentially solid interior.

2. The barrier system of claim 1, wherein the two first angled side faces extend at an angle on either side of the longitudinal axis.

3. The barrier system of claim 1, wherein the at least one fastener extends through an opening formed in the first or second barrier segment, the opening being slot-shaped.

4. The barrier system of claim 1, wherein the pair of elastic pads are made from rubber, neoprene or a similar material that is suitable to absorb mechanical strain.

5. The barrier system of claim 1, wherein the pair of elastic pads at least partially covers an entire contact area between the pair of wedge-shaped connectors and the first and second angled faces.

6. The barrier system of claim 1, further including a first metal cap disposed to at least partially cover an end of the first barrier segment, the first metal cap defining the first angled face.

7. The barrier system of claim 6, wherein the first metal cap is integrated with and embedded into the end of the first barrier segment.

8. The barrier system of claim 6, wherein the first metal cap is plate-shaped in a tri-fold configuration.

9. The barrier system of claim 1, wherein the first barrier segment is made from normal-weight concrete material.

10. The barrier system of claim 1, wherein the first barrier segment is made from a light-weight concrete material.

11. The barrier system of claim 1, further comprising at least one support structure disposed between the first barrier segment and a support surface, the at least one support structure configured to support the first barrier segment above the support surface.

12. The barrier system of claim 11, wherein the at least one support structure is elastically-deformable when the first barrier segment is subjected to an impact.

13. The barrier system of claim 11, further comprising at least one sliding post disposed between the first barrier segment and a support surface, the at least one sliding post configured to slidably support the first barrier segment above and relative to the support surface.

14. The barrier system of claim 13, wherein the at least one sliding post includes a support member having a skid plate-like base structure that is configured to slide on the support surface when the sliding post is tilted from an impact force on the first barrier segment.

15. The barrier system of claim 1, wherein at least one essentially solid interior comprises concrete.

16. The barrier system of claim 1, wherein an angle between an axis of rotational symmetry of each of the at least one fasteners and a perpendicular to a surface of the one angled side face through which the fastener passes is less than an angle between the axis of rotational symmetry of each of the at least one fasteners and the longitudinal axis.

17. The barrier system of claim 16, wherein the angle between the axis of rotational symmetry of each of the at least one fasteners is essentially perpendicular to the surface of the one angled side face through which the fastener passes.

18. The barrier system of claim 1, wherein each of the pair of wedge-shape connectors includes an angle-shaped wall having a first outer orthogonal face adapted to engagingly oppose a first angled side face of the first concrete barrier and a second outer orthogonal face adapted to engagingly oppose a second angled side face of the second concrete barrier.

19. The barrier system of claim 18, wherein each of the wedge-shaped connectors includes a plurality of pairs of openings to accommodate a respective one of the at least one fasteners, each opening of each pair of openings disposed through a respective one of the first orthogonal face and the second orthogonal face.

20. The barrier system of claim 19, wherein each of the wedge-shaped connectors includes a plurality of strengthening ribs each extending orthogonally between the angle-shaped wall and perpendicularly with respect to the first outer orthogonal face and the second outer orthogonal face, each of the strengthening ribs located between adjacent sets of openings over the height of the respective wedge-shaped connector.

* * * * *